US011478896B2

(12) United States Patent
Sohn López-Forment et al.

(10) Patent No.: US 11,478,896 B2
(45) Date of Patent: Oct. 25, 2022

(54) MIXER MODULE FOR A DETERMINISTIC HYDRODYNAMIC TOOL FOR THE PULSED POLISHING OF OPTICAL SURFACES, AND PULSED POLISHING METHOD

(71) Applicant: UNIVERSIDAD NACIONAL AUTÓNOMA DE MÉXICO, Mexico City (MX)

(72) Inventors: Erika Sohn López-Forment, Mexico City (MX); Elfego Guillermo Ruiz Schneider, Mexico City (MX); Luis Salas Casales, Ensenada (MX); Esteban Antolin Luna Aguilar, Ensenada (MX)

(73) Assignee: UNIVERSIDAD NACIONAL AUTÓNOMA DE MÉXICO, Mexico City (MX)

( * ) Notice: Subject to any disclaimer, the term of this patent is extended or adjusted under 35 U.S.C. 154(b) by 691 days.

(21) Appl. No.: 16/467,316

(22) PCT Filed: Nov. 8, 2017

(86) PCT No.: PCT/MX2017/000127
§ 371 (c)(1),
(2) Date: Jun. 6, 2019

(87) PCT Pub. No.: WO2018/106100
PCT Pub. Date: Jun. 14, 2018

(65) Prior Publication Data

US 2020/0061775 A1 Feb. 27, 2020

(30) Foreign Application Priority Data

Dec. 9, 2016 (MX) ..... MX/a/2016/016317

(51) Int. Cl.
*B24C 1/08* (2006.01)
*B24C 3/32* (2006.01)
(Continued)

(52) U.S. Cl.
CPC ..... *B24C 7/0038* (2013.01); *B24C 1/04* (2013.01); *B24C 1/08* (2013.01); *B24C 3/32* (2013.01); *B24C 7/0015* (2013.01); *B24C 7/0084* (2013.01)

(58) Field of Classification Search
CPC ..... B24C 1/003; B24C 1/006; B24C 1/04; B24C 1/08; B24C 3/32; B24C 5/08;
(Continued)

(56) References Cited

U.S. PATENT DOCUMENTS 5,786,236 A 7/1998 Thompson et al.
5,969,368 A 10/1999 Thompson et al.
(Continued)

FOREIGN PATENT DOCUMENTS

CN 104308745 A 1/2015
CN 105150112 A 12/2015
WO 2005007343 A1 1/2005

OTHER PUBLICATIONS

English Translation of International Search Report (ISR) for PCT/MX2017/000127 dated Apr. 16, 2018 (2 pages).
(Continued)

*Primary Examiner* — Eileen P Morgan
(74) *Attorney, Agent, or Firm* — Shumaker, Loop & Kendrick, LLP

(57) ABSTRACT

A hydrodynamically optimized mixer module, to be coupled to a deterministic hydrodynamic tool that allows pulsed polishing of optical surfaces is described. This module allows the supply of abrasive foam or fluid that enters the tool to be interrupted without impairing the operational
(Continued)

stability of the polishing process and of said hydrodynamic tool. The mixer module includes at least one interrupter element for switching high-velocity fluids; a first inlet through which air is injected under pressure and in a controlled manner; a second inlet through which a polishing fluid is injected in a controlled manner, said polishing fluid filling a predetermined volume with a hydrodynamically optimized shape and being transferred to a mixing zone where, together with the pressure-injected air, an abrasive foam is produced that is injected into at least one rotational acceleration chamber of the hydrodynamic tool to which the mixer module is coupled.

10 Claims, 3 Drawing Sheets

(51) Int. Cl.
*B24C 1/04* (2006.01)
*B24C 7/00* (2006.01)

(58) Field of Classification Search
CPC ... B24C 7/0007; B24C 7/0015; B24C 7/0038; B24C 7/0046; B24C 7/0053; B24C 7/0084; B24C 13/00
USPC ..... 451/2, 38, 39
See application file for complete search history.

(56) References Cited

U.S. PATENT DOCUMENTS

| | | | | |
|---|---|---|---|---|
| 5,971,835 | A | 10/1999 | Kordonski et al. | |
| 6,106,380 | A | 8/2000 | Jacobs et al. | |
| 6,354,923 | B1 * | 3/2002 | Lankford | B24B 1/04 451/910 |
| 6,503,414 | B1 * | 1/2003 | Kordonsky | B24B 1/005 252/62.52 |
| 7,169,012 | B2 * | 1/2007 | Ruiz-Schneider | B24C 1/08 451/38 |
| 7,997,110 | B2 * | 8/2011 | Carter | B24C 1/003 451/39 |
| 2008/0176487 | A1 * | 7/2008 | Armstrong | B24C 1/003 451/39 |
| 2021/0114885 | A1 * | 4/2021 | Mueller | B08B 5/023 |

OTHER PUBLICATIONS

Booij et al. "Nanometer deep shaping with fluid jet polishing", Optical Engineering, Aug. 2002, vol. 41, No. 8, pp. 1926-1931.
Booij et al., "Computational model for prediction of shaping with FJP and experimental validation", OF & T Conference, Tucson, Jun. 2002, pp. 52-54.
Fahnle et al., "Fluid jet polishing of optical surfaces", Applied Optics, Oct. 1998, vol. 37, No. 28, pp. 6771-6773.
R.N. Wilson, "Reflecting Telescope Optics II Manufacture, Testing Alignment, Modern Techniques", Springer-Verlag, 1999 and Wilson SR et al., SPIE vol. 966, No. 74, 1988.

* cited by examiner

MIXER MODULE FOR A DETERMINISTIC HYDRODYNAMIC TOOL FOR THE PULSED POLISHING OF OPTICAL SURFACES, AND PULSED POLISHING METHOD

FIELD OF THE INVENTION

The present invention relates to techniques and principles used in Astronomy and high-precision Optics, as well as the development of tooling that allows carrying out a process that goes from corrective grinding to high precision polishing on surfaces requiring high optical quality, and more specifically, the invention relates to a mixer module for a deterministic hydrodynamic tool to accomplish pulsed polishing of optical quality surfaces, as well as a method for carrying out pulsed polishing.

BACKGROUND OF THE INVENTION

The process of optical quality polishing, fine or high-precision polishing consists of roughing the surface material to be polished to smooth it, and to correct its figure with wavelength fraction accuracies.

In the field of high-precision optics and microelectronics, and more specifically, in terms of optical flattening of semiconductor surfaces, high-precision grinding and polishing is carried out with different modern techniques.

Conventional polishing methods, also known as classical polishing methods (R. N. Wilson "*Reflecting Telescope Optics II, Manufacture, Testing, Alignment, Modern Techniques*" Springer Verlag, 1999. and Wilson S R, et al., *SPIE* Vol. 966, 74, 1988), mainly use contact tools made of elastic materials (pitch, polyurethane, and the like) that precisely mold to the surface to be polished, exerting friction through an abrasive suspension layer. These polishing procedures tend to be artisanal and slow, and deform polishing tools due to temperature and torsion generated during the process, with a consequent tool wear where abrasive and removed material are embedded. Furthermore, conventional polishing methods have other disadvantages, such as: it is only possible to polish high hardness materials; work surfaces are deformed by pressure exerted on them by tools requiring rigid supports for them; they tend to leave a fallen edge due to a semi-rigid contact material and the lack of support of the tool on the edge; the size of the tool is necessarily changed to make zonal corrections; they work with harmonic machines that do not have the advantages of a machine with several degrees of freedom as required, for example, for polishing an off-axis surface.

The problems of the methods disclosed above were overcome by using "stressed lap" type tools, consisting of tools that actively deform to polish spherical surfaces more easily. However, these are complex methods and one of their important limitations is that precision working on surface edges is not possible, obtaining what is known in the field of optics as fallen edge surfaces.

The state of the art shows other more updated methods than those already disclosed, which are used for fine polishing of optical surfaces, namely: polishing by means of an ion beam (Ion Beam Figuring, which is an excellent method for correction of errors on an optical surface, also known as "corrective polishing"); polishing by means of magnetorheological fluids; and polishing by fluidic jets (Fluid Jet Polishing). Characteristics and limitations of each are described below:

Polishing by means of an ion beam is described in U.S. Pat. Nos. 5,786,236 and 5,969,368, where said technology is based on the bombardment of the surface to be polished with a collimated ion beam of inert gas, thus producing material removal. This technology only allows fine polishing of a previously prepared and polished surface. The process is iterative, based on an error map of the work surface that is used to correct imperfections. This method requires a vacuum chamber, at least the size of the piece to be polished, thus being expensive and complex; performing optical interferometric tests is not possible during the polishing process, which complicates the iterative polishing/testing process; surface micro-roughness remains practically intact due to an orthogonal beam incidence on the surface.

A polishing method by means of magnetorheological fluids is described in U.S. Pat. Nos. 5,971,835 and 6,106,380, consisting of confining a magnetic fluid with abrasive on a rotating cylinder perimeter area which is hardened under the influence of a magnetic field, generating a polishing tool. Polishing is achieved by controlling the part to be polished on the magnetorheological fluid circulating on the rotating cylinder. Another variant of this method is to collimate an abrasive magnetorheological liquid flow by means of a magnetic field, making it collide with the work surface.

On the other hand, fluid jet polishing (Booij, S. M., et al., *Optical Engineering, August* 2002, vol. 41, No. 8, pp. 1926-1931 and Booij, S. M., et al., *I. OF&T conference*, Tucson, June 2002, pp. 52-54. and O. Fähnle at al., *Appl. opt.* 38, 6771-6773~1998) is the first fluid-based polishing technology developed, grinding the surface to be polished with an abrasive fluid beam. The jet is directed to the surface through a nozzle placed at a certain angle and distance from the work surface. This polishing method has limitations because the generated erosion footprint is very small and generates low removal rates. Surfaces that can be polished are small and the tool is limited to meet the needs of high precision polishing in the fields of large surface optics.

On the other side, the state of the art also identifies Mexican Patent No. 251048 by the same inventors of the present invention, which describes a useful tool for fine or high-precision grinding and polishing of flat and curved optical surfaces, including edges, as well as for optical flattening of semiconductor and metal surfaces, without coming into contact with them, exerting zero force on the work surface. Said tool was developed to solve problems that the available technology had not solved at such time, because in addition to the above discussed limitations, each of the polishing and grinding methods showed another significant limitation related to the fact that the use of more than one technology was needed to achieve a high-precision finish on a surface.

The hydrodynamic tool of Mexican patent No. 251048 has no moving parts and is arranged by interchangeable modules, namely a mixer module that mixes two or more components of a polishing substance to form an abrasive foam that includes a porous cavity to control the density of said abrasive foam; a module of at least one rotational acceleration chambers that have an optimized hydrodynamic geometry, that minimizes random turbulence and creates a single, organized vortex that allows the mixture of air and abrasive fluid to be rotationally accelerated. These acceleration chambers include a set of power injectors in its periphery; an aerostatic suspension system, that generates a fluid layer over which the tool floats, and said fluid layer allows said tool to adjust its position with respect to the work surface by means of a series of aerostatic bearings; a throat actuator; an exit nozzle; a diverging radial nozzle; and a material recovery ring.

In the mixer module, a high velocity flow, consisting of an abrasive foam, is produced, which, when leaving the hydrodynamic tool, radially and parallel to the work surface, expands onto the work surface creating abrasion in an annular, stable, uniform and repeatable footprint. This footprint, dependent upon the tool operational parameters, namely abrasive fluid supply flow, density and pressure, as well as pressurized air supply pressure, consists of a central low pressure zone, surrounded by a high pressure zone that cancel each other out, giving the tool a self supporting capacity or buoyancy. The hydrodynamic tool permits carrying out all the processes needed to obtain a very high-precision optical surface, from corrective grinding to fine polishing without the need of changing tools, avoiding friction against the work surface, wear and deformation of the tool, and also allowing polishing of thin membranes without requiring rigid or active supports for the work piece.

However, and despite its versatility, the hydrodynamic tool of Mexican Patent No. 251048 shows the limitation of not being able to interrupt its erosive action during the polishing process due to its internal hydrodynamic geometry. The operating parameters of the hydrodynamic tool, which consist of a controlled supply of pressurized air and polishing fluid into said tool, create the stability conditions that give the tool the ability to float over the surface to be polished, also called tool buoyancy or self supporting capacity, that also form the tool erosion footprint that produces erosion that removes material in a controlled manner. Interrupting any of these supplies will break up the stability conditions: the tool will cease to float over the work surface and the tool influence function will lose its erosive power. As mentioned above, interrupting the supply of the polishing solution causes the tool to lose its stability and buoyancy, requiring it to always be turned on, which forces requires having to sweep the entire surface which removes material in the process. This reduces the overall efficiency of the polishing process, as erosion will always be present, even in areas where polishing is not necessary, forcing higher than necessary process times, as well as excessive removal of material. This is disadvantageous for work on large surfaces, where polishing times can be tens of hours per run, and where polishing should not be interrupted in order to prevent the formation of splicing scars.

In order to solve the limitations of the hydrodynamic tool described above, a new mixer module is presented here that is coupled to the hydrodynamic tool from Mexican Patent No. 251048, and replaces the original mixer module of said patent, where the internal design of the mixer module in which the foaming step is carried out has been modified, so that the supply of polishing solution can be interrupted without losing the operational stability of the process, allowing polishing by "poxel" (Polishing Element) that, together with the hydrodynamic tool advantages possessed by Mexican Patent No. 251048, henceforth, the "hydrodynamic tool", results in a much more competitive tool in the sense of obtaining a more efficient convergence towards the intended surface, also being capable of performing pulsed polishing actions which said hydrodynamic tool of the state of the art cannot achieve.

SUMMARY

The present invention relates to a mixer module that is to be coupled to the hydrodynamic tool, designed to be able to interrupt the supply of an abrasive fluid without losing the operational stability of the hydrodynamic tool and the polishing process. What is intended is that said abrasive fluid remains inside the polishing tool for less than one millisecond, and once the flow is cut off, high internal velocities of pressurized gases are used to empty said tool. The mixer module is comprised of: at least one high-velocity fluid interrupter element that can be disposed inside or outside of the body of said mixer module, whose function is to interrupt the supply of controlled pressure and flow of abrasive fluid; a first inlet through which pressurized air is injected under control, being supplied by the polishing system of the hydrodynamic tool to which it is coupled; a second inlet through which a polishing fluid is injected in a controlled manner, which in the preferred embodiment of the present invention, is an abrasive suspension of polisher and water, this polishing fluid is also supplied by the polishing system of the hydrodynamic tool to which said module is attached, wherein said polishing fluid fills a predetermined volume which is then transferred to a mixing zone, and in conjunction with the pressurized air, an abrasive foam is produced which is then injected into at least one of the rotational acceleration chambers of the hydrodynamic tool to which said mixer module is attached.

The density of the abrasive foam depends on the pressure ratio with which air is injected into one inlet of the module, and the polishing fluid into the other inlet of the module. It is important to ensure that the abrasive foam dwell time is less than one millisecond within this mixing step.

In a further aspect of the present invention, a method for carrying out the deterministic polishing process is also described by using the deterministic hydrodynamic polishing tool having the mixer module of the present invention coupled to it, comprising the steps of: (a) generating an error map of the work surface to be polished from an interferogram; (b) parting from the error map, generating a dwell time map or pulse duration map of the deterministic hydrodynamic polishing tool for each position on the surface to be polished; (c) obtaining, in conjunction with the influence function or specific erosion footprint for each polishing tool, a motion map for a polishing robot which allows to sweep the entire work surface to be swept in order to obtain the desired optical figure; (d) carrying out the deterministic pulsed polishing on the work surface being able to use more than one hydrodynamic polishing tool, onto which the mixing module of the present invention is coupled, simultaneously mounted on a single machine or several independent machines and in different arrangements; and, (e) generating a new error map of the polished work surface, and as necessary, repeating steps (a) through (d) until the desired optical figure is obtained.

The capacity of the mixer module of the present invention to interrupt the supply of abrasive fluid, allows the hydrodynamic tool to implement a series of new polishing techniques that increase the efficiency and overall performance of polishing with such tool, such as: pulsed polishing; zonal polishing; pulse width modulation polishing (PWM, acronym for Pulse Width Modulation)); tessellation polishing; pixel polishing; interruption of the polishing run; edge polishing; convergence to the desired figure; multiple head polishing.

Likewise, the mixer module to be coupled to the deterministic hydrodynamic tool allows for several arrangements which accommodate multiple hydrodynamic tools for simultaneous polishing, such as: multi-tool polishing in linear arrangement; multi-tool polishing in matrix arrangement; multi-tool polishing in spiral arrangement, and multi-tool polishing on one or more machines using the above cited arrangements and other arrangements.

Taking into account the limitations found in the state of the art, an object of the present invention is the provision of a mixer module to be coupled to a deterministic hydrodynamic tool with an internal geometry that minimizes random turbulence and allows pulsed polishing of optical surfaces, as said tool is provided with the ability to instantly interrupt the abrasive effect, but without losing the stability of the operational parameters and buoyancy of the hydrodynamic tool onto which the mixer module of the present invention is coupled and which are described in the background section.

Another object of the present invention is to provide the mixer module with the ability to be coupled to a deterministic hydrodynamic tool for pulsed polishing of optical surfaces, making said tool even more versatile and efficient since, besides allowing polishing only in those areas where correcting the surface is necessary but without having to travel the entire optical surface and remove material where not necessary, allows resuming the polishing process after being interrupted for any reason, eliminating "scars" generated by the inability to make a good splice.

A further object of the present invention is to provide the mixer module with the ability to be coupled to a deterministic hydrodynamic tool for pulsed polishing of optical surfaces. This allows carrying out said pulsed polishing by tessellation (or by sectors), since polishing paths can be spliced without leaving a footprint "scar".

Still a further object of the present invention is to provide the mixer module with the ability to be coupled to a deterministic hydrodynamic tool for pulsed polishing of optical surfaces allowing polishing adjacent areas with one or more hydrodynamic tools without leaving a footprint or scar by means of tessellation polishing that optimizes the splice path.

Still another object of the present invention is to provide the mixer module with the ability to be coupled to a deterministic hydrodynamic tool for pulsed polishing of optical surfaces, where the pulsed polishing in turn allows to simultaneously polish a surface with several hydrodynamic tools, with independent polishing action for each of them, considerably reducing the polishing time of said surface and increasing the overall process efficiency.

Even another object of the present invention is to provide the mixer module with the ability to be coupled to a deterministic hydrodynamic tool for pulsed polishing of optical surfaces that allows to linearly modulate the erosive process, since, unlike the hydrodynamic tool of radial flow found in the state of the art, with the mixer module coupled to said hydrodynamic tool, a velocity map is calculated from the error map of the surface to be polished to correct the surface and, parting from the error map, a time map with different pulse durations is calculated, so that the pulse duration determines the volume removed by each "poxel".

Still another object of the present invention is to provide a method for carrying out deterministic hydrodynamic pulsed polishing, using the hydrodynamic tool coupled to the mixer module of the present invention.

The above objects, as well as other objects not described, features and advantages of the mixer module to be coupled to a deterministic hydrodynamic tool for pulsed polishing of optical surfaces of the present invention will be apparent for a person skilled in the art from the detailed description of certain embodiments and attached Figures, in addition to the appended claims.

BRIEF DESCRIPTION OF THE FIGURES

Novel aspects that are deemed characteristic of the present invention will be particularly established in the appended claims. However, the invention itself, both by its organization and its method of operation, together with other objects and advantages thereof, will be better understood in the following detailed description of the embodiments of the present invention, when read in connection with the accompanying drawings wherein:

DETAILED DESCRIPTION OF THE EMBODIMENTS OF THE INVENTION

Figure 1:
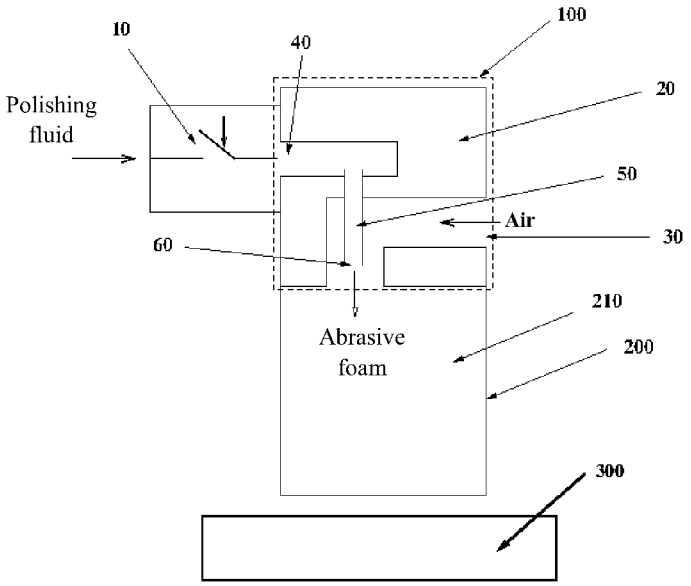
FIG. 1 is a graphic representation of a cross section of a mixer module coupled to a deterministic hydrodynamic tool for pulsed polishing of optical surfaces, which has been built in accordance with a particularly preferred embodiment of the present invention.

For the purpose of clarification and understanding of the present description, a small glossary of terms that have been and will be used throughout this document are set forth below:

Work surface, work piece: Surface to be polished.

Generation: Shaping a 3D surface (usually a mathematical equation) on a solid object by means of rigid, flexible or fluidic abrasive tools (final error~100 μm).

Grinding: A process after generation consisting of removing surface material from any solid by means of friction, cutting or by high-hardness microscopic solid particle impact (final error of 1-10 μm).

Polishing: Final finish of a specular surface where the surface error and roughness are less than 20 nm.

Fine polishing: Final finish of a specular surface where the surface error and roughness are both less than 10 Angstrom.

Stability: Ability of the tool of the present invention to keep the erosion footprint constant during its operation.

Repeatability: Ability of the tool of the present invention to keep the erosion footprint constant during several operating cycles.

Uniformity: Ability of the tool of the present invention to keep the erosion footprint constant and axisymmetrical.

Deterministic Process: A process where the same input parameters to a system will invariably produce the same outputs or results, not involving randomness or process uncertainty.

Tessellation: Regularity or pattern of figures that completely cover a surface that meets two requirements: i) no remaining spaces between the figures; and, ii) The figures do not overlap.

Pulse-width modulation: Pulse-width modulation (PWM) of a signal or power source is a technique wherein the duty cycle of a periodic signal is modified to control the amount of abrasive power with which a surface is polished;

Poxel: (polishing element) Unit of area corresponding to the erosion footprint size of the tool and defining the maximum spatial resolution with which a surface can be polished.

CNC: (Computer Numerical Control). Any computer controlled machine to position and sweep the polishing tool over the work surface.

Tool influence function (TIF) or tool footprint or tool erosion footprint: material removal characteristic of the polishing tool. It is obtained by measuring a sample of the same material that will be polished before and after having been in contact with the polishing tool in a controlled way.

Error map: A map of the surface to be polished that shows the deviation from the actual surface to the desired surface figure.

It is important to remark that the hydrodynamic tool described in Mexican Patent No. 251048 carries out three operative stages that rotationally accelerate the abrasive foam generated in the mixer module. This abrasive foam is radially expelled onto the work piece, creating a grazing erosive action from abrasive particles that removes material. The rotation of the abrasive foam, accelerated by the action of the tangential injectors of the acceleration chamber, in conjunction with a nozzle with a divergent geometry, creates a vortex with a low pressure central area surrounded by a high pressure region. The pressures in these regions cancel each other out over the work surface (300). As a result, the tool floats on said work piece and does not exert any net force on the surface to be polished. In addition, this buoyancy capacity self-aligns the tool parallel to the surface to be polished, giving it a stable self-adjusting capacity, which is referred to as tool stability. The ability to expel the abrasive foam at a high velocity and in a grazing way generates high removal rates, as well as low residual roughness and exerts zero force on the surface (300) to be polished.

However, as discussed in the background section, said hydrodynamic tool of Mexican Patent No. 251048 works continuously, that is, it always remains turned on when in use and does not allow the interruption of its erosive action during the polishing process, forcing it to have to sweep the entire work surface, and therefore, removing material where not necessary, since, in case of interrupting the supply (which is done by alternating the On/Off switch) of the abrasive fluid, cavitation effects are caused that prevent the tool from restarting its operation once the abrasive fluid supply has been interrupted and therefore losing its stability and buoyancy.

In order to solve the above problem, the mixer module of the hydrodynamic tool is redesigned in such way that the polishing fluid flow can be interrupted without said tool losing stability and buoyancy during its operation.

In view of the foregoing, a new mixer module (100) was designed and developed to be coupled to a deterministic hydrodynamic tool (200), and more specifically, to the hydrodynamic tool described and claimed in Mexican Patent No. 251048. Said mixer module (100) has the ability to instantaneously interrupt the abrasive effect, but without said hydrodynamic tool (200) losing the stability of its operating parameters. This further increases the tool versatility and efficiency, as polishing only in regions where necessary is now possible, being able to correct a work surface (300) without needing to scan the entire work surface, avoiding the removal of material where not necessary.

The mixer module (100) is designed to be able to interrupt the abrasive fluid supply without losing the operational stability of the process, and the tool (200) can operate in pulsed mode, carrying out polishing by "poxel". What is intended is that said abrasive fluid remains inside the polishing tool (200) for less than one millisecond and once the flow is cut off, the high internal velocities of the pressurized gases are used to empty said tool (200).

With reference to FIG. 1 of the accompanying drawings, the cross section of the hydrodynamic polishing tool (200) is graphically illustrated, and more specifically, the mixer module (100), indicated inside a dashed line, which is described in accordance with a particularly preferred embodiment of the present invention and generally comprising: at least one high-velocity fluid interrupter element (10) that can be arranged inside or outside the body (20) of said mixer module (100), which function is to switch the supply of polisher fluid at a controlled flow and pressure. In the present invention the use of, but not limited to, a high-velocity solenoid electrovalve as an interrupter element (10) is preferred, as any other device allowing rapid pulsation of fluids may be used such as electromechanical, piezoelectric, fluidic, or pneumatic, and the like; a first inlet (30) through which pressurized air is injected under control; the pressurized air is supplied by the polishing system that also supplies pressurized air to the tool (200) onto which said mixer module (100) is coupled; a second inlet (40) through which a polishing fluid is injected in a controlled manner; the polishing fluid is supplied by the polishing system that supplies polisher fluid to the tool (200) onto which said mixer module (100) is coupled, which in the preferred embodiment of the present invention is an abrasive suspension of polisher and water, wherein said polishing fluid fills a chamber with a predetermined volume (50) that is designed so that the polishing fluid dwell time in said volume is less than 1 millisecond, so as not to lose the operating parameters and self-supporting capacity of the tool (200) described in the background section of this document, and wherein said polishing fluid is transferred to a mixing zone (60), a volume where the pressurized air coming in through the air inlet (30) generates a drag that empties the abrasive fluid present in the predetermined volume (50) and creates an abrasive foam that is then injected into the first of at least one of the rotational acceleration chambers (210) that are part of the of the hydrodynamic tool (200) of Mexican Patent No. 251048 to which the mixer module (100) is coupled.

The density of the abrasive foam depends on the pressure ratio with which air is injected through the air inlet and polishing fluid is injected through the polisher inlet. It is important to ensure, through the switching control signal of the fluid interrupter (10) that the abrasive foam dwell time is less than one millisecond within this mixing step so as not to lose the operating parameters and tool buoyancy, described in the background section of this document.

Special care has been given to the internal geometry of the mixer module (100) so it is possible to turn the input of the abrasive fluid on and off at high frequency without losing the stability conditions that produce the self-supporting ability of the tool over the work surface (300). This is achieved by finding the appropriate ratio of the volume of the chamber containing the incoming polisher fluid (50) to the volume of the air inlet chamber (30). This ratio fixes the volume of the chamber (50).

The switching pulse duration is controlled by an electric signal from a polishing system computer, that is part of the polishing system that controls the operation the polishing tool (200), that actuates at least one interrupter element (10) to obtain a deterministic material removal. The erosion is proportional (linear) to the pulse duration of the polishing fluid. Erosion is now a proportional (linear) function of pulse duration, allowing pulse width modulation (PWM) polishing mode and obtaining roughing resolutions of up to 1 Å/ms (0.1 nm/ms). This action makes it possible to precisely polish a finite surface element the size of the tool erosion footprint.

In a further embodiment, the present invention describes a method for carrying out a deterministic polishing process using the deterministic hydrodynamic polishing tool (200) having the mixer module (100) described above coupled to it, and comprising the following steps:

(a) generating an error map of the work surface (300) to be polished, parting from an interferogram, using, but not limited to, an interferometer, while any other high resolution optical metrology instrument can be used;

(b) generating a dwell time or pulse duration map of the deterministic hydrodynamic polishing tool (200) for each position on the surface to be polished (300);

(c) obtaining, in conjunction with the influence function or erosion footprint particular to each polishing tool, a motion map for a polishing robot, allowing to sweep said work surface to be polished (300) to obtain the desired optical figure;

(d) carrying out the deterministic pulsed polishing on the work surface (300), being able to either use one or more than one hydrodynamic polishing tools simultaneously and mounted on the same machine or several independent machines and in different tool arrangements; and (e) generating a new error map of the polished work surface (300), when necessary, repeating steps (a) through (d) until the desired optical figure is obtained.

For most of the current polishing methods in use, including the tool described in Mexican Patent No. 251048, a velocity map is required that sweeps the tool over the surface, varying the velocity at each point, depending on the amount of material that must be removed. For the specific case of said Mexican Patent No. 251048 tool, as it cannot be turned off during the polishing process, polishing process efficiency is limited in the sense that there is always a minimum material removal (other than zero) associated with the maximum velocity at which the tool may be swept with the polishing robot. With the hydrodynamic tool (200) coupled to the mixer module (100) described in the present invention, erosive action of the tool (200) may be interrupted, thus allowing pulsed polishing of a surface, with which a linear erosion function may be generated where removal is no longer a function of the polishing robot sweeping velocity, but of the pulse duration on each surface point, thus allowing generating dwell time maps with high precision removal rates from zero to the maximum removal obtainable with the tool, at a constant sweep velocity. This new capacity of the hydrodynamic tool (200) allows the implementation of a series of new polishing techniques that increase the efficiency and general performance of polishing with this tool, as described below:

Pulsed Polishing

Figure 2:
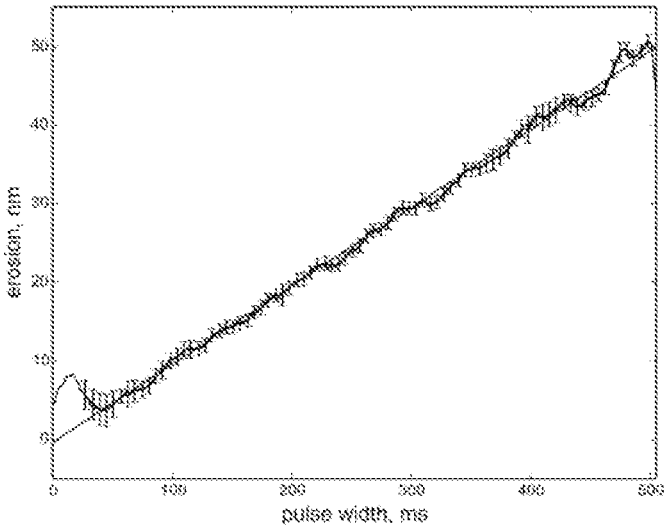
FIG. 2 is a graph showing the results of erosion vs. pulse width.

The modification of the mixer module (100) that is coupled to the hydrodynamic tool (200) allows generating polishing pulses that may be implemented either as individual pulses, equivalent to polishing per unit area (poxel), or as a continuous sweep of the tool (200) at a constant velocity, varying the pulse width and using pulse width modulation (PWM) techniques. This allows to achieve removals from zero up to the maximum removal rate allowed by the tool (200). The fact that the erosive action of said tool (200) may be pulsed, leads to a linear process, where removal (moving the tool (200) at constant velocity) is a function of the turn-on time of the tool, as shown in FIG. 2 of the accompanying drawings.

Zonal Polishing

When the correction of only a region of the work surface is necessary, in the case of polishing with the tool of the Mexican Patent No. 251048, it is necessary to cross the surface with the tool turned onto the region in question, leaving unwanted approach footprints as well as exit prints in the region to be polished. While, as previously mentioned, this problem is solved by pulsating the abrasive effect (200) of the tool having the mixer module (100) coupled, that is, the tool (200) is approached operating it with Y=0, where Y is the working cycle of the PWM pulse width, until reaching a constant width dampening band that surrounds the area of interest. When tool (200) enters the dampening band, its velocity begins to change smoothly until reaching the required value in the region of interest. Within the area of interest the erosive action of said tool (200) is turned on and polishing by using any of the methods, or combination of methods, as described below, is possible, for example, pulse width modulation (PWM), tessellation or continuous polishing.

Polishing by Pulse Width Modulation

The design of the mixer module (100), allows to control the erosive pulse duration as a fraction of the time taken by the tool (200) to travel the distance equivalent to the size of its erosion footprint. Depth h of the material removed for a path is given by $$h - \frac{D_v Y}{VS}$$

where Dv is the volumetric removal ratio (characteristic of each tool), Y is the working cycle of the PWM pulse width (the time divided by T), V is the velocity of the CNC or polishing robot and S is the size of the travel step.

On/Off period of the signal is T=D/V where D is the diameter of the polishing tool footprint, such that in the time taken to travel the footprint diameter there is a pulse which duration may be varied from zero to the equivalent time to travel the footprint width at a given sweep velocity.

Depth $h=\beta\tau$ of removed material is proportional to the dwell time of the tool $\tau$, where $\tau=YD/V$, with $\beta=Dv/SD$. For the case of Y=1, the classic or continuous removal case is shown and roughing is controlled with the CNC sweep velocity.

In the pulsed mode, where Y<1 removal is controlled by the pulsed supply of abrasive foam in combination with the sweep velocity. In continuous mode, the minimum possible removal of material is limited by the maximum CNC velocity. To obtain smaller removals, polishing by pulse width should be used.

For the case in which the duty cycle is varied between 0 and 1, at constant CNC velocity, creation of a pixellated pattern is possible that may be used to determine the tool (200) response function.

Tessellated Polishing

Figure 5:
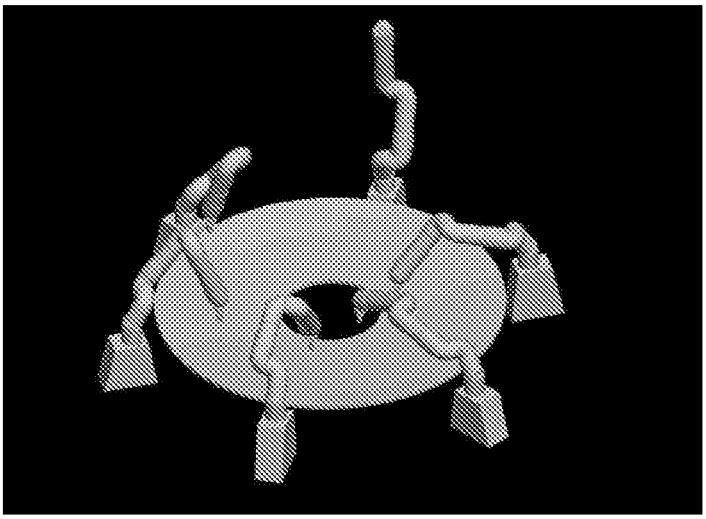
FIG. 5 illustrates a plurality of deterministic hydrodynamic tools having the mixer module coupled to allow pulsed polishing to be carried out, and said hydrodynamic tools are mounted on several independent polishing robots.

For polishing large surfaces (larger than one meter), the tool efficiency of Mexican Patent No. 251048 is limited by the size of the erosion footprint, as well as by the volumetric removal rate of the tool itself. However, increasing the process efficiency is possible by simultaneously polishing the surface with several hydrodynamic tools (200). This new polishing method, in addition to allowing the combination of independently polished adjacent zones, eliminating splice footprints between them, permits simultaneously polishing a surface with several hydrodynamic polishing tools (200); where each of said tools (200) has the mixer module (100) coupled to it. This decreases the processing time as a function of the number of tools (200). Each polishing tool (200) can be mounted on a robot, as shown in FIG. 5 of the accompanying drawings, or instead, on articulated robot arms (serial) or parallel robots (hexapod), or also on one or several robotic arms with multiple heads in linear, matrix or spiral arrangements. Moreover, the tools (200) can be mounted on any numerical control machine that allows simultaneous polishing with several tools on a surface.

Tools (200) may be mounted on independent polishing robots (CNC), where each robot polishes a certain section of the surface. This method has several drawbacks, such as obtaining non-smooth overlapping areas, as well as possible collisions between tools while approaching adjacent polishing areas.

Figure 6:
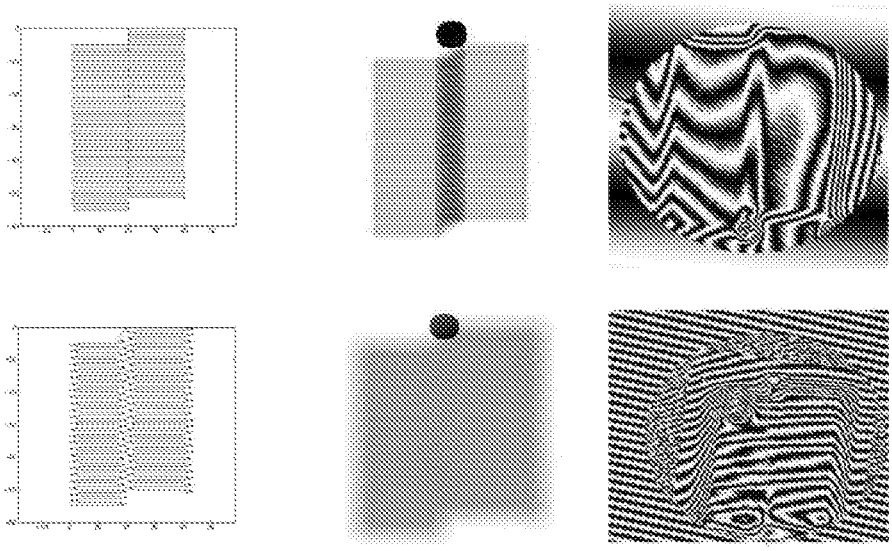
FIG. 6 illustrates various images obtained with tessellation polishing, where the left column images show the paths to follow for rectangular "raster" polishing (upper) and for tessellated polishing (lower); the central column images show a splice simulation for both paths; and the right column images show interferograms of surfaces polished with both methods.

In order to obtain smooth splicing footprints between two independent polishing zones, approaching the boundary between zones is necessary by following special paths, which have been termed as tessellated paths (refer to FIG. 6 of the accompanying drawings). This path form avoids duplicating dwell time in the splice area, as for example, in the case of a square or rectangular "raster" sweep pattern.

Another possibility is to vary the pulse width of each tool in the overlap zone, so that the combined dwell time is the required in that area to obtain a smooth splice.

In the case where two independent paths match in time at a point on the boundary between polishing zones, it is possible to decelerate one of the tools (200), turn it off and wait for the other tool (200) to complete its sweep in this area and then re-start the first tool (200) to continue with its polishing path.

As illustrated in FIG. 6 of the accompanying drawings, images in the left column show the paths to be followed for rectangular "raster" polishing (upper) and for tessellated polishing (lower); images of the central column show a simulation of splices for both paths; and images in the right column show interferograms of surfaces polished with both methods. The upper image set shows the splicing region of two independently polished surfaces using a rectangular sweep pattern, the upper right image shows how the overlap zone, as well as the footprint of the starting position of the polishing path are very apparent. The lower image set shows an example of a sweep path incorporating a tessellated path in the splice area, in the lower right image the splice zone is not apparent.

Pixel Polishing

In the case of polishing by pulse width modulation (PWM) at constant velocity, the polishing response function in the sweep direction is different from that of the direction perpendicular to the sweep direction. To obtain a symmetric response, the use of a polishing method by pixel or discrete polishing is possible. It consists of moving the tool (200) to discrete positions over the workpiece, covering the region of interest with the same step increment in both axes. For each position, the tool (200) is turned on for the time necessary to obtain the desired removal. This method is useful for areas where very localized polishing is required, allowing following either a raster type sweep pattern, or any path or set of discrete positions over the region of interest.

Interruption of the Polishing Run

With the option of being able to turn the erosive effect of the tool (200) on and off by means of the mixer module (100) at any place and time of the polishing process, an interruption of the polishing process and continuation of the same at any other time is possible.

Edge Polishing

Similarly to other polishing techniques, polishing with the tool from Mexican Patent No. 251048, leaves fallen edges on the surface to be polished, with a width corresponding to the erosion footprint diameter of the tool. Said problem is solved by increasing tool velocity when approaching the edge of the work piece, reducing the dwell time and therefore, the amount of material removed in that region to adapt it to the necessary amount that needs to be removed at the edge; however, this may generate CNC control problems, since the tool is being accelerated in a region where the CNC needs to prepare for a change of direction, for example, in the case of a raster-type sweep pattern.

The ability to pulse the tool (200) allows to alleviate this problem, since dwell time may be controlled without the need to increase tool velocity on the surface edge to be polished. In fact, this method allows decelerating the CNC in preparation for a change of direction.

Convergence

An additional advantage of pulsed polishing is that it is possible to converge more quickly towards the desired surface. In the case of polishing with Mexican Patent No. 251048 tool, the imposition of having to remove a minimum quantity other than zero due to the impossibility of turning the tool's erosive power off, limits the amount of material that may be removed in each polishing run. While pulsating the tool (200) it is possible to achieve zero removal, as well as increased convergence ratios.

Polishing with Multiple Heads

Since the tool's erosive process may be pulsed, mounting multiple tools (200) on a common robotic arm is possible, which may be moved at a constant velocity on the surface to be polished. Dwell time for each tool is controlled using pulse width modulation (PWM), as required by the error map.

Taking advantage of the self-sustaining capacity of the tool (200) it is also possible not to have to use independent positioning systems for each of the tools (200) to ensure their parallelism on the work surface (300). Only one degree of freedom is required per tool (200), implemented by means of linear movement along the axis perpendicular to the surface, in conjunction with a force measuring device to guarantee polishing with zero force on the work surface (300) and being able to follow the local curvature or figure, as well as surface plane inclination.

Another advantage of this method is that the use of only one polisher feeding system for all the tools (200) is possible. This simplifies the system, increases efficiency and reduces costs.

Polishing process efficiency now becomes a function of the number of tools (200).

Simultaneous polishing with several tools (200) assigns a surface section to be polished to each tool (200) and the borders between sections may be polished free of scars, either by means of the tessellation polishing method or by using pulse width modulation polishing (PWM), as described above.

On the other hand, there are several possible arrangements to accommodate multiple tools (200) for simultaneous polishing, such as, but not limited to, polishing in linear, matrix or spiral arrangements. These arrangements are described below:

Multi-Tool Polishing in Linear Arrangement

By assembling several deterministic polishing tools (200) on a polishing arm moved by means of a polishing robot (either a Cartesian CNC or robotic arm or any device for controlled tool movement), covering an area by moving the arm in "X" and "Y" directions is possible. Each tool (200) is placed at a fixed distance 6 from the other on the "X" axis. Sweep action on "X" axis is done by moving the arm a distance 6 in this direction and advancing with the desired sweep pattern on the "Y" axis. The splice between polished sections for each tool (200) is handled by means of either tessellation or pulse width (PWM) polishing method, as described above.

There are some considerations that should be taken into account for this method, such as polishing the edges when polishing circular or non-rectangular surfaces. There will be times when at least one tool (200) is entering or leaving the surface to be polished, while others continue polishing. Since this method takes advantage of the self-supporting ability of the tool (200) to conform to the work surface (300), those tools (200) that approach the work surface edge (300) will lose buoyancy. These problems may be solved with an adequate path planning.

Multi-Tool Polishing in Matrix Arrangement

The linear arrangement may be expanded to any arrangement where multiple tools (200) are placed in a matrix array, mounted on a robotic device to sweep the surface to be polished. This allows maximizing the number of tools (200) and minimizing polishing time. The principle of operation is equal to the linear case, but adding m lines. This is equivalent to implementing m polishing runs in a single iteration, further increasing the efficiency of the polishing process.

Multi-Tool Polishing in Spiral Arrangement

Efficient polishing of a surface with axial symmetry is possible when positioning multiple tools (200) on a spiral arm, which in turn moves a distance 6 along one of the Cartesian axes, just as in the linear arrangement method, so that each tool (200) covers the area assigned to it. The arm may be either moved around the axis of symmetry of the surface to be polished, or rotate the surface on a turntable. Proposal and solving of a variational equation is possible for a parameterized spiral curve in such a way that "n" tools (200) are spaced apart equidistantly from each other over the entire length of this spiral curve, such that each tool (200) polishes the same area. Extension of this methodology by adding more spiral arms to increase process efficiency is also possible.

Other Arrangements and Possibilities

In order to enable tool movement (200), the use of any computer controlled mechanism as a device that allows sweeping of said tool(s) (200) on the work surface (300) to be polished is possible, including but not limited to rotary tables, Cartesian CNC machines or articulated robots. Simultaneous polishing may be also performed with multiple tools (200) mounted on multiple robots.

A combination of any of the methods described above or in conjunction with the polishing method described in Mexican Patent No. 251048 tool is also possible, depending on the particular surface to be polished, to achieve the best possible solution for a polishing problem, optimizing polishing process efficiency and converging more quickly towards the intended surface. The present invention will be better understood from the following example, which is presented solely for illustrative purposes. This allows a better understanding of the embodiments of the present invention, without implying that there are no other embodiments not illustrated that may be carried out based on the description above:

EXAMPLE

A deterministic hydrodynamic tool prototype for pulsed polishing of optical surfaces was built, having the mixer module of the present invention coupled to said tool, where said tool had a 7 mm footprint. The pulsed polishing process was tested for linearity. FIG. 2 of the accompanying drawings shows the results of erosion (removal) vs. dwell time. Pulse width varied in constant increments, from 10 milliseconds (ms) to a maximum of 500 ms. Because the tool moved incrementally by 0.2 mm, each footprint diameter of said hydrodynamic tool was overlapped 35 times. Erosion was measured using a Fizeau interferometer and the result was normalized, so that removal corresponds to a single tool pass on each point along the line being polished. Error bars are basically due to errors produced by subtraction of the base reference during interferogram reduction. A removal resolution of 0.1 nanometer/millisecond may be noticed from the data. Apparent polishing effects could be noticed starting from 25 ms. This effect may be attributed to the solenoid valve response time, where said response time may be improved by the use of faster actuators.

Figure 3:
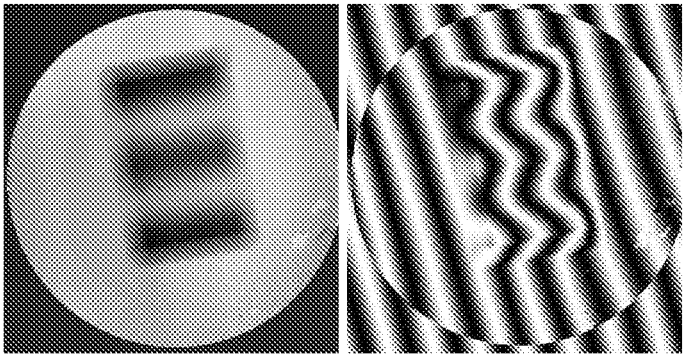
FIG. 3 illustrates a pixellated pattern, where a constant velocity of 2000 mm/min was maintained while alternating the erosive process between being turned off and on with a 5 Hz frequency.
Figure 4:
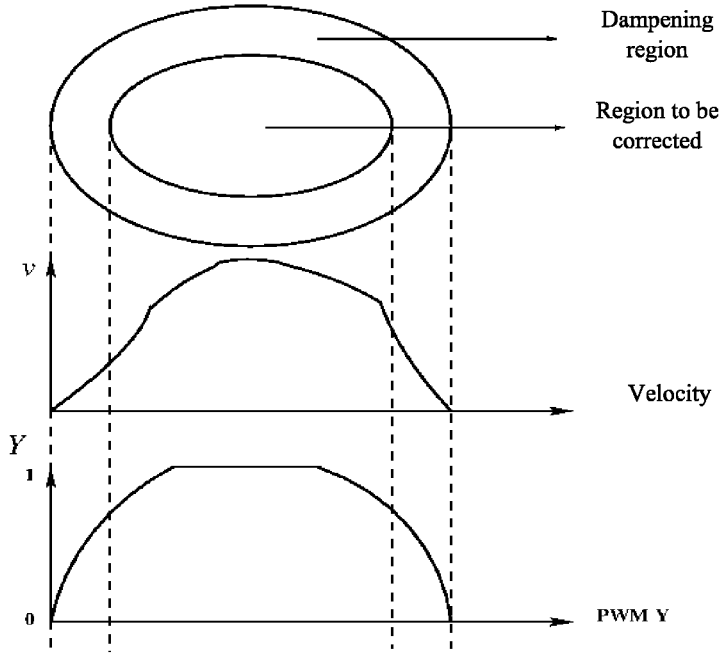
FIG. 4 illustrates zonal pulsed polishing, where an isolated region in need of more polishing has been identified, such that a dampening band of constant width surrounding this region is defined, with the minimum width corresponding to the size of the erosion footprint or "poxel".

The design of the mixer module allows to control pulse duration with respect to a frequency or pulse width modulation (PWM). For this end, the switching frequency must be kept within a tool footprint width diameter, which translates in time, for a given tool velocity. In an extreme case, where the duty cycle is changed between 0 and 1 while maintaining a constant velocity, creation of a discrete or pixellated pattern, useful for determining the pulsed tool response function, is possible. Said pattern is shown in FIG. 3 of the accompanying drawings, where a constant velocity of 2000 mm/min has been maintained while alternating the erosive process between turning the tool on and off at a 5 Hz frequency. A fringe pattern at the interface between the regions may be noted having a slope corresponding to the tool footprint diameter, which is the size of the polishing limiting element (poxel). This polishing pattern was obtained by sweeping the tool orthogonally to the pattern observed in FIG. 3.

Where only a small part of the surface needs to be polished, this region has to be managed with the hydrodynamic tool turned on, leaving behind unwanted footprints, as well as entry and exit marks. This problem is solved by means of the pulsed abrasive effect carried out with the hydrodynamic tool coupled with the mixer module of the present invention. When an isolated region in need of additional polishing is identified, a constant width dampening band surrounding it is defined, as illustrated in FIG. 4 of the accompanying drawings. Assuming that a fringe pattern is defined, the region is approached by the hydrodynamic tool in full operation, with Y=0 until entering the dampening zone. Here, the velocity is slowly increased up to the necessary value within the region, while, at the same time, dwell time is controlled by means of PWM. The dampening region width is determined by the acceleration and deceleration capabilities of the CNC. Within the region to be corrected, pulsed or continuous polishing may be used to maximize hydrodynamic tool efficiency.

When polishing large surfaces, hydrodynamic tool efficiency is limited due to the small size of its footprint and its volumetric removal. However, said efficiency may be improved by simultaneously polishing the surface with a plurality of hydrodynamic tools having the mixer module of the present invention coupled to them. Said tools may be mounted on independent polishing robots, as illustrated in accompanying FIG. 5, where each robot polishes a certain section of the surface. This is one of many options or arrangements that may be provided by simultaneously using more than one hydrodynamic tool while carrying out pulsed optical surface polishing.

Although reference has been made in the previous description to some embodiments of the mixer module to be coupled to a deterministic hydrodynamic tool for pulsed polishing of optical surfaces, as well as to said pulsed polishing process, other embodiments that were not described in detail herein may be possibly developed based on the above description. Therefore, it should be emphasized that numerous modifications to such embodiments are possible, but without departing from the true scope of the present invention, such as modifying the number and arrangement of the interrupter elements, polishing liquid, or many other modifications. Therefore, the present invention should not be restricted except as established in the state of the art, as well as by the appended claims.

The invention claimed is:

1. A mixer module designed to be coupled to a deterministic hydrodynamic tool which gives the tool the capability of pulsed polishing of surfaces with optical quality; said mixer module allows the interruption of the supply of abrasive foam to the tool without the hydrodynamic tool losing its operational stability, while giving the tool the capability of polishing a surface in a pulsed fashion; stability of the tool is not lost, since to the ratio of the volumes between a chamber that contains a polishing fluid and the volume of air that is fed into the mixing module prevents the tool from losing its internal stability;

said mixer module comprises:

a solid body that can be made of any metal, plastic or any solid material that is mechanically coupled to a hydrodynamic polishing tool; where the body of the mixer module has the following structures machined into it:

a first inlet through which pressurized air is injected at a controlled pressure;

at least one high-velocity fluid interrupter element that can be located either inside or outside the body of said mixer module, which interrupts the supply of polishing fluid that is supplied into the mixer module through;

a second inlet through which this polishing fluid is injected, filling a predetermined volume which is emptied in a small amount of time, preferably less than one millisecond, to minimize dwell time of the polishing fluid in the volume, so that the hydrodynamic tool to which it is coupled does not lose its operational parameters and self supporting capacity;

wherein:

said polishing fluid is transferred to a mixing zone and, together with the pressurized air coming from the first inlet, creates a drag that empties the polishing fluid that is present in the chamber with a predetermined volume, producing an abrasive foam; and said foam exits the mixing module and is injected into one or more rotational acceleration chambers of the hydrodynamic tool to which it is coupled;

and wherein said fluid interrupter element allows to interrupt the supply of abrasive foam to the tool without the hydrodynamic tool losing its operational stability due to the ratio of the volumes between the chamber that contains the polishing fluid and the volume of air that is fed into the mixing module while giving the tool the capability of polishing a surface in a pulsed fashion.

2. The mixer module according to claim 1, wherein the high-velocity fluid interrupter element is a device that allows rapid switching of fluids.

3. The mixer module according to claim 2, wherein the high-velocity fluid interrupter element is a high-velocity solenoid valve.

4. The mixer module according to claim 3, wherein pulse duration is controlled by switching the solenoid valve to obtain a pulsed deterministic material removal.

5. The mixer module according to claim 1, wherein the density of the abrasive foam depends on the ratio of pressures with which the air and the polishing fluid are injected into the mixing module, with the produced abrasive foam remaining less than one millisecond in said mixer module.

6. The mixer module according to claim 1, wherein said mixer module is configured to turn the supply of polishing fluid to the hydrodynamic tool to which it is coupled off and on at high frequency maintaining the stability conditions of said tool.

7. The mixer module according to claim 1 coupled to a hydrodynamic polishing tool, wherein erosion or material removal is proportional to the pulse duration of the polishing fluid to precisely polish a finite surface element of the size of the tool erosion footprint of the tool onto which the mixing module is coupled.

8. The mixer module according to claim 1, wherein coupling said module to the hydrodynamic deterministic tool allows the hydrodynamic tool to perform zonal polishing; pulse width modulation (PWM) polishing; tessellation polishing; pixel polishing; interruption of the polishing run; edge polishing; optimal convergence polishing; and multiple head polishing.

9. The mixer module according to claim 1, wherein coupling said module to the hydrodynamic deterministic tool allows to carry out polishing with a plurality of arrangements to accommodate multiple hydrodynamic tools on computerized polishing robots, for simultaneous polishing, comprising, but not limited to: linear, multi-tool polishing arrangements; matrix or array polishing tool arrangements; spiral multi-tool arrangements.

10. A method for carrying out a deterministic polishing process using a deterministic hydrodynamic polishing tool coupled with the mixer module of claim 1, wherein the mixer module is comprised of a solid body made of any metal, plastic or any solid material mechanically coupled to a hydrodynamic polishing tool, the body of the mixer module having the following structures machined into it; a first inlet through which pressurized air is injected at a controlled pressure; a second inlet through which polishing fluid is injected, wherein, by means of fixing the ratio of the volume of the chamber containing the incoming polisher fluid to the volume of the air inlet chamber, the polishing fluid fills a chamber with a predetermined volume with an internal hydrodynamic geometry that allows it to be emptied in a small amount of time, preferably less than one millisecond, to minimize dwell time of the polishing fluid in the volume, so that the hydrodynamic tool to which it is coupled does not lose its operational parameters and self supporting capacity; and at least one high-velocity fluid interrupter element that can be located either inside or outside the body of said mixer module, which interrupts the supply of polishing fluid that is supplied into the mixer module through the second inlet;

the method, comprising the steps of:

(a) generating an error map of the work surface to be polished parting from an interferogram obtained with an interferometer or any other high-resolution metrological instrument, preferably an interferometer;

(b) generating a dwell time or pulse duration map for the deterministic hydrodynamic polishing tool for each position on the surface to be polished;

(c) obtaining, in conjunction with the tool influence function or the tool erosion footprint that is specific to each polishing tool, a motion map for a polishing robot onto which the polishing tool is attached, that allows sweeping said work surface to be polished to obtain a desired optical figure;

(d) carrying out a deterministic pulsed polishing on the work surface by more than one hydrodynamic polishing tool simultaneously mounted either on the same machine or several independent machines and in different arrangements; and (e) if the desired optical figure is not obtained, generating a new error map of the polished work surface, when necessary, repeating steps (a) through (d) until the desired optical figure is obtained.

* * * * *